United States Patent [19]

Martin et al.

[11] 4,143,603

[45] Mar. 13, 1979

[54] METHOD AND FURNACE FOR COMBUSTION OF PRIMARY FUELS WITH MOISTURE CONTAINING SECONDARY FUELS

[75] Inventors: Johannes J. Martin; Walter J. Martin; Horst Kammholz, all of Munich, Fed. Rep. of Germany

[73] Assignee: Josef Martin Feuerungsbau GmbH, Munich, Fed. Rep. of Germany

[21] Appl. No.: 801,657

[22] Filed: May 31, 1977

[30] Foreign Application Priority Data

Mar. 6, 1976 [AT] Austria ..... 4062/76

[51] Int. Cl.[2] ..... F23G 5/02

[52] U.S. Cl. ..... 110/222; 110/346

[58] Field of Search ..... 110/222, 255, 346

[56] References Cited

U.S. PATENT DOCUMENTS

| | | | |
|---|---|---|---|
| 2,005,082 | 6/1935 | Greenawalt | 110/257 |
| 3,769,921 | 11/1973 | McMullen | 110/222 |
| 4,056,069 | 11/1977 | Marshall | 110/346 |

*Primary Examiner*—Kenneth W. Sprague
*Attorney, Agent, or Firm*—Peter K. Kontler

[57] ABSTRACT

A moisture-containing viscous secondary fuel is combusted in the chamber of an industrial furnace by comminuting the secondary fuel to a particle size of 5–50 mm and propelling the particles at an initial speed of 1–10 m/sec. onto a layer of intensely burning primary fuel, such as solid refuse, coal or wood. The particles are propelled from a level at 0.5–2 m above the burning layer and in such a way that the length of their flight spans is 0.2–2 m. This insures that the particles retain moisture during travel in the combustion chamber and do not agglomerate prior and/or subsequent to contacting the burning layer of primary fuel. The rate of admission of comminuted secondary fuel is regulated in dependency on changes of temperature in the chamber, in dependency on changes of the $CO_2$ or $O_2$ content of combustion products and/or in dependency on variations of a parameter (e.g., length) of the burning layer of primary fuel.

21 Claims, 5 Drawing Figures

METHOD AND FURNACE FOR COMBUSTION OF PRIMARY FUELS WITH MOISTURE CONTAINING SECONDARY FUELS

BACKGROUND OF THE INVENTION

The present invention relates to furnaces in general, especially to industrial furnaces for the burning of refuse or the like, and more particularly to improvements in a method and furnace for combustion of secondary (normally lower-quality) fuels simultaneously with primary fuels, especially for combustion of unprocessed or partially processed viscous secondary fuels having the consistency of mud or slime with a primary fuel which may constitute refuse or a conventional fuel (such as wood, coal or the like).

It is known to feed finely comminuted sludge which is removed from settling tanks into the ascending current of gaseous combustion products in an industrial furnace. The level of the locus of admission of finely comminuted sludge is selected in such a way that a certain percentage of descending sludge particles is fully relieved of moisture and the remainder of the particles is likely to be subjected to partial drying before the particles reach the burning layer of primary fuel on the grate. The descending particles are dried by a portion of hot gases which rise above the grate; to this end, such portion of the gases is segregated from the remaining hot gases and is fed into the path of descending sludge particles which are normally caused to cover a substantial distance prior to reaching the grate.

The just described conventional method exhibits a number of drawbacks. Thus, the particles which are completely dried before they reach the grate are entrained by the ascending gases and are not combusted at all or are oxidized outside of the combustion chamber. Furthermore, relatively large particles are dried only in the region of their exposed surfaces. When a partially dried particle reaches the grate and happens to come to rest on a mass of partially combusted fuel, its outermost layer is converted into coke while the core remains uncombusted. The particle is thereupon caused to leave the combustion chamber together with the slag. Attempts to prevent such partial combustion of sludge particles include the provision of complex and expensive devices which insure that the size of all comminuted particles is within a rather narrow range, i.e., a range which guarantees pronounced reduction of moisture content of each and every particle and complete combustion of a high percentage of dried particles on their way toward the layer of primary fuel on the grate. Such comminution of sludge can be achieved only with substantial expenditures in energy. Moreover, secondary fuel having a muddy consistency cannot be readily comminuted with a sufficient degree of predictability so that the descending shower of particles of secondary fuel invariably contains a relatively high percentage of larger particles which undergo partial combustion prior to evacuation from the combustion chamber.

In accordance with certain other presently known proposals, the period of dwell of particles of sludge in a hot atmosphere is prolonged to such an extent that all or nearly all particles are adequately dried prior to descending onto the burning layer of primary fuel. A drawback of such proposals is that the rate of admission of secondary fuel cannot be regulated with a requisite degree of predictability.

OBJECTS AND SUMMARY OF THE INVENTION

An object of the invention is to provide a method of combusting secondary fuels at a predictable rate, without any or with negligible preliminary treatment, and in such a way that each and every fragment or particle of secondary fuel is completely combusted before it leaves the combustion chamber.

Another object of the invention is to provide a method of the just outlined character which can be resorted to for complete or practically complete combustion of highly viscous secondary fuels which exhibit a strong tendency to agglomerate.

A further object of the invention is to provide a method which insures predictable combustion of moisture-containing secondary fuels even if such fuels are not subjected to a pronounced comminuting action.

An additional object of the invention is to provide a method of combusting secondary fuels, such as sludge, on contact with refuse or other types of primary fuel.

Another object of the invention is to provide a novel and improved furnace which can be utilized for the practice of the above outlined method.

An ancillary object of the invention is to provide the furnace with novel and improved means for treating secondary fuel immediately prior to admission into the combustion chamber.

A further object of the invention is to provide the furnace with novel and improved means for conveying particles of secondary fuel in the combustion chamber.

One feature of the invention resides in the provision of a method of combusting a moisture-containing secondary fuel (e.g., a viscous mass) in the combustion chamber of an industrial furnace or the like. The method comprises the steps of establishing and maintaining a body (preferably a layer) of intensively burning primary fuel (which may constitute refuse, coal or the like), comminuting the secondary fuel (e.g., by resorting to rotary comminuting means), and conveying metered quantities of comminuted secondary fuel into contact with the body of primary fuel (preferably by showering or propelling particles of secondary fuel onto the burning body of primary fuel) without appreciable changes in the moisture content of comminuted secondary fuel in the course of the conveying step (i.e., during travel of such particles between the locus or loci of admission into the combustion chamber and the points of contact with the burning body). It is desirable to maintain the particles of comminuted secondary fuel in the chamber and out of contact with the burning body or layer of primary fuel for an interval of at most one second, preferably between 0.1 and 0.5 second. This insures that the gaseous products of combustion cannot appreciably reduce the moisture content of particles of secondary fuel during travel in the combustion chamber toward the burning layer of primary fuel. The particles of comminuted secondary fuel can be propelled across or in the combustion chamber at an initial speed of between one and ten meters per second, preferably from a level located at a distance of between 0.5 and 2 meters above the burning layer of primary fuel and at an initial speed at which the length of flight spans of propelled particles is between 0.2 and 2 meters. The comminuting step preferably includes reducing the secondary fuel to a particle size in the range of 5 to 50 millimeters.

The metering operation can be carried out in a number of ways. For example, the method may comprise the additional steps of monitoring changes of temperature in the combustion chamber and regulating the rate of admission of comminuted secondary fuel as a function of such changes. If the temperature drops, the rate of admission of secondary fuel is reduced, and vice versa. Alternatively, or in addition to the just mentioned steps, one can monitor changes in the percentage of $CO_2$ and/or $O_2$ gas in the combustion products and regulate the rate of admission of comminuted secondary fuel as a function of such changes. Still further, one can monitor a variable parameter of the burning layer of primary fuel (e.g., the length of such layer) and regulate the rate of admission of comminuted secondary fuel as a function of variations of the parameter. Such regulation can be effected in addition to or as a substitute for one or more previously described regulating procedures.

The novel features which are considered as characteristic of the invention are set forth in particular in the appended claims. The improved furnace itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
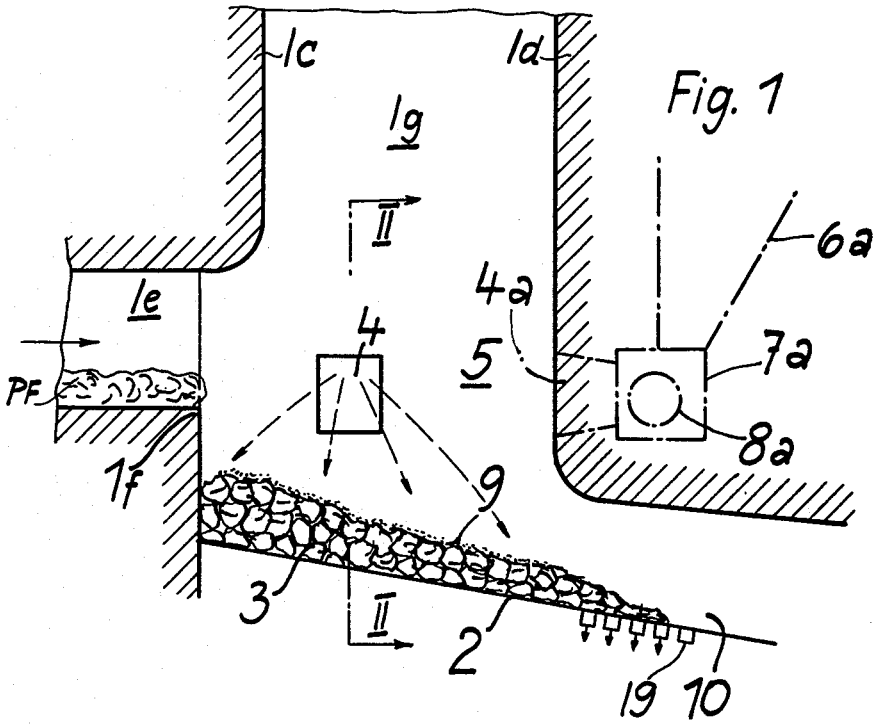
FIG. 1 is a fragmentary schematic longitudinal vertical sectional view of a furnace which embodies one form of the invention.
Figure 2:
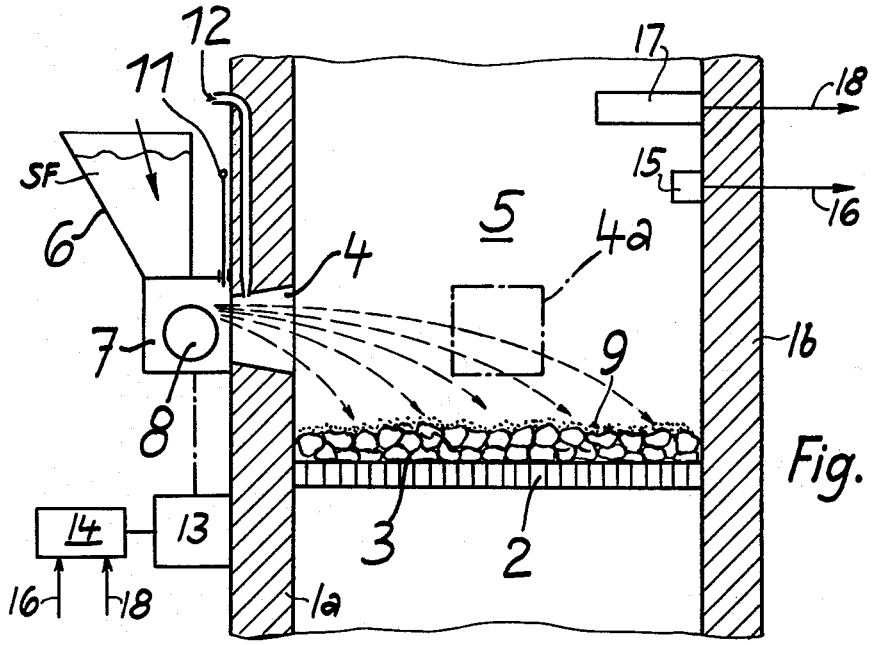
FIG. 2 is a transverse vertical sectional view substantially as seen in the direction of arrows from the line II—II in FIG. 1.

Referring first to FIGS. 1 and 2, there is shown an industrial furnace which defines a combustion chamber 5 bounded by side walls 1*a*, 1*b*, end walls 1*c*, 1*d* and an inclined bottom wall or grate 2. The end wall 1*c* is formed with an inlet 1*e* for admission of primary fuel PF in the direction indicated by arrow. The fuel PF overflows an edge 1*f* of the end wall 1*c* and descends onto the grate 2 to form thereon a body or layer 3 which is ignited so that it burns and produces intense heat. Gaseous products of combustion rise into a duct 1*g*. The reference character 10 denotes an outlet provided between the grate 2 and end wall 1*d* and serving for evacuation of solid combustion products, such as ash, slag and the like. The construction of means for feeding primary fuel PF (e.g., wood, solid refuse, conventional fuel or a mixture of these) to the inlet 1*e* and for insuring that the layer 3 of primary fuel in the chamber 5 undergoes intensive oxidation forms no part of the present invention.

The side wall 1*a* has an opening or window 4 located in front of a rotary comminuting device 8 which receives a continuous stream of viscous secondary fuel SF from a suitable source 6 (e.g., a hopper or chute) and is driven by a variable-speed prime mover 13 to propel particles of comminuted secondary fuel into the chamber 5 wherein the particles descend by gravity and form a stratum 9 on top of the layer 3. The prime mover 13 can be said to constitute a means for conveying or propelling particles of secondary fuel SF into the combustion chamber 5. The reference character 7 denotes a housing which surrounds the major part of the rotary comminuting device 8 and has an opening for admission of secondary fuel SF from above as well as an opening in register with the opening or window 4. The direction in which the supply of secondary fuel flows into the housing 7 is indicated by an arrow.

The rotary comminuting device 8 may comprise one or more disks or cylinders which are provided with teeth or other types of projections to comminute the descending stream of secondary fuel SF so that the size of particles which are propelled into the chamber 5 via opening 4 is preferably in the range of 5 – 50 millimeters. Any other comminuting instrumentality or instrumentalities or shredders can be used with equal advantage, as long as they can comminute secondary fuel at the required rate and as long as they can reduce the size of secondary fuel to that within the aforementioned range. The intensely burning layer 3 of primary fuel PF causes immediate and complete combustion of particles of secondary fuel which form the stratum 9. It is assumed that the entire layer 3 is in the process of intensive combustion; this can be insured by feeding hot gases against the underside of the grate 2. Direct contact between the particles of the stratum 9 and the glowing particles of the layer 3 insures that the particles of secondary fuel cannot agglomerate on top of the layer 3 whereby each such particle undergoes complete combustion. As a particle of secondary fuel reaches or approaches the burning layer 3, the moisture therein is vaporized and expands so that the particle "explodes" with attendant pronounced increase of exposed surface area which promotes rapid and complete combustion of the particle. Thus, the comminution of secondary fuel SF in the housing 7 is followed by a further comminution of mechanically comminuted particles on contact with the layer 3, and such further comminution results in very pronounced additional reduction of particle size. The stratum 9 travels steadily with the layer 3 toward and into the outlet 10 below the end wall 1*d* of the furnace.

FIGS. 1 and 2 further show, by phantom lines, a second opening 4*a* which is provided in the end wall 1*d* opposite the inlet 1*e* and is located in front of a second comminuting device 8*a* which is partially confined in a housing 7*a* and receives secondary fuel from a source 6*a*. The prime mover for the comminuting device 8*a* is not shown in the drawing; this comminuting device can be driven by the prime mover 13 or by a discrete prime mover. The openings 4 and 4*a* may but need not be located at the same level above the grate 2; their level depends on the speed at which the particles of secondary fuel are propelled therethrough and on the initial angle of travel of particles immediately after they leave the respective housings.

The apparatus including the comminuting device 8*a*, housing 7*a* and source 6*a* can be provided in addition to or as a substitute for the parts 6 – 8. Furthermore, the opening 4*a* can be provided in the side wall 1*a*, in the side wall 1*b* or in the end wall 1*c*. All that counts is to insure that the length of intervals during which the particles of comminuted secondary fuel dwell in the chamber 5 (and are out of contact with the layer 3) is less than or does not appreciably exceed one second. This, combined with relatively short flight spans, insures that the moisture content of particles of secondary fuel changes very little or not at all during travel between the housing 7 or 7a and the layer 3.

Figure 3:
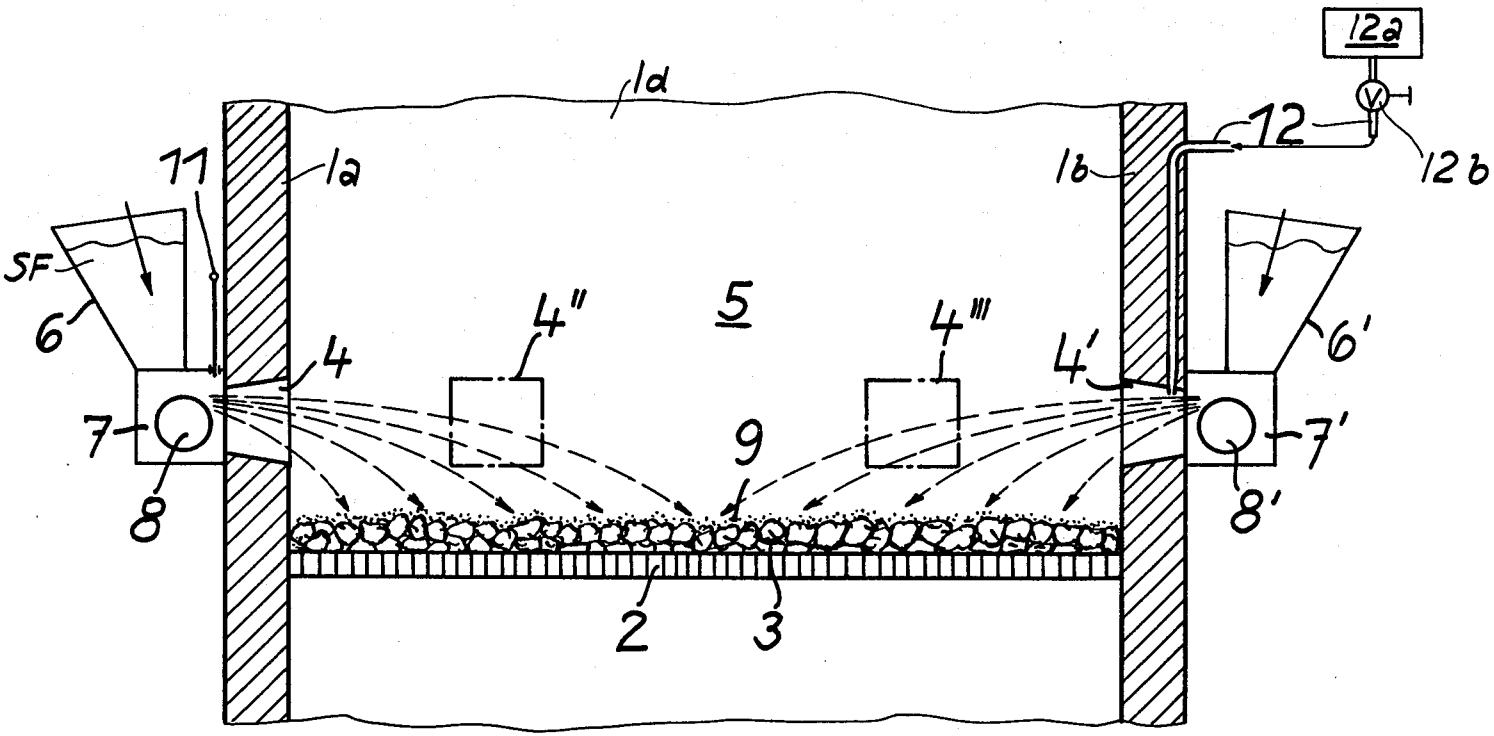
FIG. 3 is a schematic transverse vertical sectional view of a modified furnace.

FIG. 3 shows a portion of a second furnace with a wide grate 2 which supports an intensely burning layer 3 of primary fuel. The side walls 1a and 1b are respectively formed with openings 4 and 4' for admission of particles of secondary fuel which are propelled by comminuting devices 8, 8' installed in housings 7, 7' and respectively receiving secondary fuel from sources 6 and 6'. The end wall 1d has two openings 4'' and 4''' which admit additional particles of secondary fuel propelled by comminuting devices (not shown) behind the wall 1d. The manner in which primary fuel is fed into the chamber 5 and in which solid residues of primary and secondary fuel are evacuated from the chamber of FIG. 3 is preferably the same as described in connection with FIG. 1.

The furnace of FIG. 3 can be provided with only two openings (e.g., with openings 4'' and 4'''), with three openings (e.g., 4, 4' and 4'' or 4, 4'' and 4''', etc.), with a single opening, or with five or more openings, depending on the dimensions of the layer 3 and the capacity of individual comminuting devices.

It is preferred to provide the furnace with means for shielding the comminuting device or devices when the respective prime mover or prime movers are idle. FIG. 3 shows a reciprocable gate 11 which is movable to and from an operative position in which it extends across the opening 4 and protects the comminuting device 8 from intense heat in the combustion chamber above the grate 2. The shielding means may also comprise a source 12a of a suitable fluid (e.g., water, air, another gas or steam) and one or more conduits 12 which convey the fluid from the source 12a transversely across the opening 4' to protect the comminuting device 8' from intense heat when the respective prime mover is idle. The fluid which flows across the opening 4' forms a curtain which constitutes a heat-insulating film between the interior of the chamber 5 and the housing 7'. Similar shielding means are or can be provided for the opening 4'' and/or 4'''. FIG. 1 shows that the shielding means for the opening 4 may comprise a reciprocable gate 11 as well as a source of fluid (not shown) and one or more conduits 12. If desired, the furnace can be equipped with means (not shown) for automatically moving the gate 11 to the operative position and for automatically opening a valve 12b (FIG. 3) in the conduit 12 in response to stoppage of the corresponding comminuting device or devices.

FIG. 2 further shows that the speed of the prime mover 13 (and hence quantity and flight spans of particles of secondary fuel) can be regulated by monitoring the temperature of gases in the duct 1g and by transmitting appropriate signals to a control unit 14 which changes the speed of the prime mover 13 when the temperature of gases in the duct 1g changes. The temperature monitoring means is shown at 15, and the operative connection between the monitoring means 15 and control unit 14 is indicated at 16.

The speed of the prime mover 13 can be regulated in a number of other ways. For example, the control unit can receive signals from a device 17 which monitors the percentage of $CO_2$ or $O_2$ gas in the combustion products rising in the duct 1g. This device is connected with the control unit by conductor means 18. Still further, the speed of the prime mover 13 can be regulated in dependency on variations of a variable parameter of the layer 3. As shown in FIG. 1, the furnace may comprise a battery of devices 19 which monitor the length of the layer 3 (as considered in the direction of advancement of layer 3 toward and into the outlet 10). Each monitoring device 18 which is adjacent to a burning layer of primary fuel transmits a signal, and the speed of the prime mover 13 is a function of the number of transmitted signals. The arrangement may be such that the speed of the prime mover (and hence quantity and length of flight spans of particles of secondary fuel) can be changed in response to signals from two or more different monitoring devices.

The variable-speed prime mover 13 can be replaced with a constant-speed motor. The respective comminuting device or devices then receive torque through the medium of a variable-speed transmission whose ratio is changed in response to signals from one or more monitoring devices.

FIGS. 1 to 3 merely show one type of furnace which can be utilized for the practice of the improved method. The invention can be embodied in a wide variety of furnaces including so-called whirling chamber furnaces (without gates), all types of grate firing furnaces including travelling grate furnaces, and rotary furnaces. All that counts is to insure that comminuted secondary fuel is conveyed into contact with a burning body of primary fuel in such a way that the particles of comminuted secondary fuel cannot agglomerate during travel toward or subsequent to contact with primary fuel.

Figure 4:
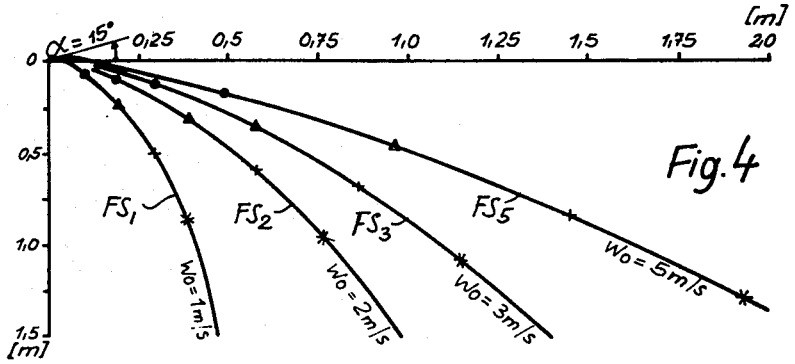
FIG. 4 is a graph showing the flight spans of particles of secondary fuel at different speeds.

The graph of FIG. 4 shows four different flight spans of particles of comminuted secondary fuel. It is assumed that the intersection (0) of the abscissa with the ordinate is located at the level of the opening 4 of FIG. 2 or 3, that the length of flight spans (in meters) is measured along the abscissa, and that the distance (in meters) between the opening 4 and the layer 3 is measured along the ordinate. The initial speed ($W_o$) of a particle having the flight span $FS_1$ is one meter per second, and the initial speed of particles having flight spans $FS_2$, $FS_3$ and $FS_5$ is respectively 2, 3 and 5 meters per second. The particles having flight spans $FS_1$, $FS_2$, $FS_3$ and $FS_5$ are propelled by the respective comminuting devices in such a way that they initially travel upwardly at an angle $\alpha$ of 15 degrees to the horizontal. It will be seen that a particle having the flight span $FS_5$ will cover a distance of 1.45 meters from the opening 4 in a direction toward the opposite side wall of the furnace and will descend through a distance of 0.85 m within an interval of 0.3 second. Thus, if the opening 4 is placed at a level of 0.85 meter above the layer 3 and the prime mover 13 drives the comminuting device 8 at a speed which insures that the initial speed of particles of comminuted secondary fuel is approximately 5 meters per second, the particles will reach the burning layer within an interval which is only a small fraction of one second.

The symbols "o" denote the positions of particles having flight spans $FS_1$, $FS_2$, $FS_3$ and $FS_5$ after elapse of 0.1 second following propulsion from the housing 7; the symbols "Δ" denote the positions of such particles after 0.2 second; the symbols "+" denote the positions of such particles after 0.3 second; and the symbols "*" denote the positions of respective particles after 0.4 second.

Figure 5:
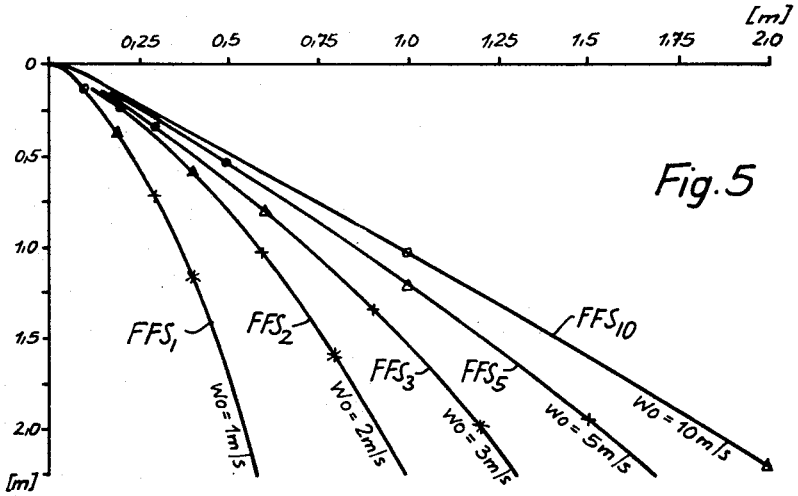
FIG. 5 is a similar graph showing the flight spans of particles of secondary fuel at different speeds, the direction of admission of particles into the combustion chamber being different from the initial direction of particles whose flight spans are shown in FIG. 4.

FIG. 5 shows the flight spans $FFS_1$, $FFS_2$, $FFS_3$, $FFS_5$ and $FFS_{10}$ of particles of secondary fuel whose initial speed (on leaving the housing 7) is approximately 1, 2, 3, 5 and 10 meters per second. The difference between the flight spans of FIG. 5 and those shown in FIG. 4 is attributable to the fact that the initial or foremost portion of the path along which the particles of FIG. 5 travel is horizontal. It will be seen that, even though the initial speed (5 meters per second) of a particle having the flight span $FFS_5$ is the same as that of an article having the flight span $FS_5$ of FIG. 4, the particle with flight span $FFS_5$ will cover a distance of 1.5 m (as measured along the abscissa) and a distance of 2 m (as measured along the ordinate) within an interval of 0.3 second. Thus, after elapse of such interval, the particle having the flight span $FFS_5$ will be located at approximately the same distance from the side wall 1b as the particle having the flight span $FS_5$ but the first mentioned particle will descend through a distance which is more than twice the extent of descent of the last mentioned particle.

The flight spans which are shown in FIGS. 4 and 5 are calculated in accordance with equations hereinbelow (such equations are well known; see for example page 377 of the 27th edition of the German-language Engineers' Handbook entitled "HUTTE"). The horizontal distance y from the locus of propulsion (as measured along the abscissa of FIG. 4 or 5) is determined as follows: $y = w_o \cdot \cos \alpha \cdot t$, wherein $w_o$ is the initial speed of the particle and t is time in seconds. The vertical distance z from the locus of propulsion (as measured along the ordinate of FIG. 4 or 5) is determined as follows: $z = w_o \cdot \sin \alpha \cdot t - (g/2) \cdot t^2$, wherein g is acceleration due to gravity (i.e., 9.81 m/sec.$^2$). In calculating the curves denoting the flight spans of FIGS. 4 and 5, the points of such curves were determined at 0.1 second intervals. The resistance of gases in the combustion chamber 5 has been disregarded. $\alpha$ is the angle of the initial portion of path of a particle.

The graph of FIGS. 4 and 5 indicate that, when the invention is embodied in a furnace having a grate of average width and the opening or openings for admission of particles of secondary fuel are placed at a level relatively close to the burning layer of primary fuel, the period of dwell of particles in the chamber 5 between the opening and the layer is a small fraction of one second, normally between 0.1 and 0.4 or 0.1 and 0.5 second. It has been found that, when the size of particles is within the aforementioned range (5 – 50 mm), the moisture content of particles undergoes negligible changes during travel across and in the hot combustion products in the duct 1g.

The improved method and furnace exhibit a number of important advantages. Many of these advantages are attributable to the fact that, contrary to prior proposals for combustion of sludge or other types of moist secondary fuel, particles of secondary fuel SF are caused to advance toward and into contact with burning primary fuel immediately after comminution and practically without any change in their moisture content. Thus, whereas the prior methods teach at least partial drying of comminuted sludge particles on their way toward the burning body of primary fuel, the particles which leave the comminuting station or stations of the improved furnace are caused to advance toward and into contact with primary fuel within extremely short intervals of time (not in excess of one second and preferably a small fraction of one second) so that their moisture content is not reduced at all or is reduced only negligibly as a result of contact with hot gases in the combustion chamber. As a rule, the layer 3 on the grate 2 will consist of primary fuel each and every particle and each and every stratum of which is in the process of combustion so that all particles which form the upper stratum 9 contact at least one burning fragment of primary fuel. This insures that the particles which form the stratum 9 cannot agglomerate since each and every particle immediately contacts a burning portion of the layer 3. In fact, a relatively high percentage of particles of secondary fuel falls into crevices or gaps between the burning fragments of primary fuel; this is even more likely to prevent agglomeration of particles of secondary fuel on the grate. In other words, each particle of secondary fuel in or below the stratum 9 is subjected to a very intensive heating action, partially as a result of direct contact with primary fuel, partly as a result of convection and partly as a result of radiation. As mentioned above, moisture in the interior of particles of secondary fuel is vaporized practically immediately after the particles reach the layer 3 whereby the expanding vapors effect an abrupt secondary comminution of the respective particles, i.e., a secondary comminution which is tantamount to an explosion of particles of secondary fuel. As also mentioned above, secondary comminution of particles which form the stratum 9 greatly increases the area of exposed surfaces of such particles and thus insures rapid and complete combustion. The stratum 9 is not a continuous film which completely covers the layer of primary fuel in the chamber 5 but rather a porous layer which does not interfere with rapid ignition and complete combustion of primary fuel. Intensive burning of primary fuel is desirable and advantageous because it insures immediate and complete combustion of all particles of secondary fuel. Therefore, the particles of secondary fuel are not subject to coking which, as explained above, is unavoidable when one resorts to presently known methods.

Since the particles of secondary fuel need not be admitted at a level well above the layer of primary fuel, they cannot return appreciable quantities of dust into the lower part of the combustion chamber. Furthermore, and since the particles of secondary fuel cannot agglomerate during travel toward and after contact with the layer 3, they need not be subjected to a pronounced comminuting action, especially since they are caused to explode and thus undergo a secondary comminuting action as soon as they reach the body of burning primary fuel. This reduces the cost of treatment of secondary fuel prior to admission into the combustion chamber. As explained above, the length of intervals of travel of particles of secondary fuel in the combustion chamber toward the layer of primary fuel can be regulated in a number of ways, i.e., by changing the distance between the opening or openings for admission of particles of secondary fuel and the layer of primary fuel, by increasing or reducing the initial speed of particles, by regulating the speed of ascending gaseous combustion products and/or by a combination of such steps.

It is evident that relatively small particles of secondary fuel are more likely to be influenced by hot gases in the combustion chamber than the larger particles. Therefore, one would expect that the size of particles of secondary fuel should be maintained within a very narrow range. It has been found that this does not apply when the minimum particle size exceeds a predetermined value. Thus, the improved method insures predictable and complete combustion of secondary fuel if the particle size of secondary fuel is not less (or not appreciably less) than 5 mm. All particles of secondary fuel will be combusted prior to leaving the chamber 5 if their size is between 5 and 50 mm. Such comminution can be carried out by resorting to relatively simple, rugged and inexpensive instrumentalities whose energy requirements are low. Particles with a size of 50 mm will be combusted just as reliably as much smaller particles even though their moisture content does not change at all during the short period of travel in the combustion chamber toward the layer or primary fuel.

Regulation of the rate of admission of secondary fuel into the combustion chamber is desirable for obvious reasons. Thus, the particles of secondary fuel could not undergo complete combustion if the ratio of secondary fuel to primary fuel would exceed a certain value. As mentioned above, such regulation or metering can be effected in dependency on one or more variables including the temperature in the combustion chamber, the percentage of one or more specific gases in the current of gaseous products rising in the duct 1g, and one or more parameters of the burning layer of primary fuel.

The furnace will be provided with several units for admission of particles of secondary fuel when the surface of the layer of primary fuel is relatively large so that particles issuing from a single opening would have very long flight spans and would be compelled to remain in contact with hot gases for excessive periods of time.

It is further within the purview of the invention to provide the furnace with particle conveying means which are totally independent of the comminuting means. For example, the comminuting device 8 of FIG. 2 or 3 can be used in combination with a winnower or another discrete particle propelling device. Also, the device 8 can feed comminuted secondary fuel into the inlet of a pneumatic conveyor which propels the particles of secondary fuel into the combustion chamber. Such modifications will be readily understood without additional illustrations.

The aforedescribed (or analogous) shielding means prevent accumulation and incrustation of particles of secondary fuel on the comminuting devices and/or in the respective housings. The reciprocable gate 11 of FIGS. 2 and 3 can be replaced with a pivotable gate or with two or more gates which cooperate to shield the respective comminuting device from excessive heat when moved to operative positions.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. A method of combusting a moisture-containing secondary fuel in the chamber of an industrial furnace or the like comprising the steps of establishing and maintaining a body of intensely burning primary fuel; comminuting the secondary fuel so that the comminuted secondary fuel constitutes a viscous mass; and conveying metered quantities of comminuted secondary fuel into contact with the burning body of primary fuel without appreciable changes in the moisture content of comminuted secondary fuel in the course of said conveying step.

2. A method as defined in claim 1, wherein said body constitutes a layer and said conveying step includes showering comminuted secondary fuel onto said layer.

3. A method as defined in claim 2, wherein said primary fuel includes refuse.

4. A method as defined in claim 2, wherein said conveying step comprises maintaining the particles of comminuted secondary fuel in said chamber and out of contact with burning primary fuel for an interval of at most one second.

5. A method as defined in claim 4, wherein said interval is between 0.1 and 0.5 second.

6. A method as defined in claim 2, wherein said conveying step comprises propelling the particles of comminuted secondary fuel at an initial speed of between one and ten meters per second.

7. A method as defined in claim 2, wherein said conveying step comprises propelling the particles from a level located at a distance of between 0.5 and 2 meters above said layer and at an initial speed at which the length of flight spans of propelled particles is between 0.2 and 2 meters.

8. A method as defined in claim 2, wherein said comminuting step comprises reducing the secondary fuel to a particle size in the range of 5 to 50 millimeters.

9. A method as defined in claim 1, further comprising the steps of monitoring the changes of temperature in said chamber and regulating the rate of admission of comminuted secondary fuel as a function of said changes.

10. A method as defined in claim 1, further comprising the steps of monitoring a variable parameter of said body and regulating the rate of admission of comminuted secondary fuel as a function of variations of said parameter.

11. In a furnace, particularly an industrial furnace, a combustion chamber including wall means having at least one opening; means for supplying to said chamber a primary fuel which forms in said chamber an intensely burning layer; a source of moisture-containing secondary fuel; means for comminuting secondary fuel; and means for conveying comminuted secondary fuel in the form of a viscous mass via said opening onto the burning layer in said chamber without appreciable changes in the moisture content of comminuted secondary fuel intermediate said communiting means and said layer.

12. The structure of claim 11, further comprising means for shielding said comminuting means from heat in said chamber during the periods of idleness of said comminuting means.

13. The structure of claim 11, wherein said comminuting means includes a rotary comminuting device and said conveying means includes means for rotating said comminuting device.

14. The structure of claim 13, wherein said rotating means includes variable-speed prime mover means and further comprising means for changing the speed of said prime mover means.

15. A method of combusting a moisture-containing secondary fuel in the chamber of an industrial furnace or the like, comprising the steps of establishing and maintaining a body of intensely burning primary fuel; comminuting the secondary fuel; conveying metered quantities of comminuted secondary fuel into contact with the burning body of primary fuel without appreciable changes in the moisture content of comminuted secondary fuel in the course of said cnveying step, the combustion of said fuels in said chamber resulting in generation of combustion products including $CO_2$ gas; monitoring the changes in percentage of $CO_2$ gas in said combustion products; and regulating the rate of admission of comminuted secondary fuel as a function of said changes.

16. A method of combusting a moisture-containing secondary fuel in the chamber of an industrial furnace or the like, comprising the steps of establishing and maintaining a body of intensely burning primary fuel; comminuting the secondary fuel; conveying metered quantities of comminuted secondary fuel into contact with the burning body of primary fuel without appreciable changes in the moisture content of comminuted secondary fuel in the course of said conveying step, the combustion of said fuels in said chamber resulting in generation of gaseous products including $CO_2$ gas; monitoring the changes in percentage of $CO_2$ gas in said products; and regulating the rate of admission of comminuted secondary fuel as a function of said changes.

17. A method of combusting a moisture-containing secondary fuel in the chamber of an industrial furnace or the like, comprising the steps of establishing and maintaining an elongated layer of intensely burning primary fuel, the length of said layer being variable; comminuting the secondary fuel; conveying metered quantities of comminuted secondary fuel into contact with the burning layer of primary fuel without appreciable changes in the moisture content of comminuted secondary fuel in the course of said conveying step; monitoring the length of said layer; and regulating the rate of admission of comminuted secondary fuel as a function of variations of said length.

18. A method of combusting a moisture-containing secondary fuel in the chamber of an industrial furnace or the like, comprising the steps of establishing and maintaining a body of intensely burning primary fuel; comminuting the secondary fuel; conveying metered quantities of comminuted secondary fuel into contact with the burning body of primary fuel without appreciable changes in the moisture content of comminuted secondary fuel in the course of said conveying step, the combustion of said fuels in said chamber resulting in the generation of gaseous products including $CO_2$ gas and $O_2$ gas in quantities which are subject to variation and said body having at least one parameter, particularly length, which is also subject to variation; monitoring at least one of said variations; and regulating the rate of admission of comminuted secondary fuel as a function of such variation.

19. In a furnace, particularly an industrial furnace, a combustion chamber including wall means having at least one opening; means for supplying to said chamber a primary fuel which forms in said chamber an intensely burning layer; a source of moisture-containing secondary fuel; means for comminuting secondary fuel; means for conveying comminuted secondary fuel via said opening and onto the burning layer in said chamber without appreciable changes in the moisture content of comminuted secondary fuel intermediate said comminuting means and said layer; and means for shielding said comminuting means from heat in said chamber during the periods of idleness of said comminuting means, said shielding means comprising at least one gate movable to and from an operative position in which said gate closes said opening.

20. In a furnace, particularly an industrial furnace, a combustion chamber including wall means having at least one opening; means for supplying to said chamber a primary fuel which forms in said chamber an intensely burning layer; a source of moisture-containing secondary fuel; means for comminuting secondary fuel; means for conveying comminuted secondary fuel via said opening and onto the burning layer in said chamber without appreciable changes in the moisture content of comminuted secondary fuel intermediate said comminuting means and said layer; and means for shielding said comminuting means from heat in said chamber during the periods of idleness of said comminuting means, said shielding means including a source of a fluid and means for conveying said fluid from said last mentioned source substantially transversely across said opening.

21. The structure of claim 20, wherein said fluid is selected from the group consisting of air, another gas, water and steam.

* * * * *